US010527274B2

(12) United States Patent
Bosl et al.

(10) Patent No.: US 10,527,274 B2
(45) Date of Patent: Jan. 7, 2020

(54) LED RETROFIT LAMP AND COOLING ELEMENT FOR A LED RETROFIT LAMP

(71) Applicant: LEDVANCE GmbH, Garching bei Munchen (DE)

(72) Inventors: Florian Bosl, Regensburg (DE); Andreas Dobner, Wenzenbach (DE); Krister Bergenek, Regensburg (DE); Meik Weckbecker, Thalmassing (DE); Stephan Finger, Wenzenbach (DE); Andreas Kloss, Neubiberg (DE)

(73) Assignee: LEDVANCE GMBH, Garching Bei Munchen (DE)

( * ) Notice: Subject to any disclaimer, the term of this patent is extended or adjusted under 35 U.S.C. 154(b) by 4 days.

(21) Appl. No.: 15/955,372

(22) Filed: Apr. 17, 2018

(65) Prior Publication Data

US 2018/0320881 A1 Nov. 8, 2018

(51) Int. Cl.

| | |
|---|---|
| ***F21V 29/77*** | (2015.01) |
| ***F21V 29/506*** | (2015.01) |
| ***F21V 29/508*** | (2015.01) |
| ***F21K 9/232*** | (2016.01) |
| ***F21V 3/02*** | (2006.01) |
| *F21Y 107/40* | (2016.01) |

(Continued)

(52) U.S. Cl.

CPC ..... *F21V 29/77* (2015.01); *F21K 9/232* (2016.08); *F21V 3/02* (2013.01); *F21V 29/506* (2015.01); *F21V 29/508* (2015.01); *F21W 2131/103* (2013.01); *F21Y 2107/40* (2016.08); *F21Y 2115/10* (2016.08)

(58) Field of Classification Search

CPC ..... F21V 29/77; F21V 29/506; F21V 29/508; F21V 3/02; F21V 29/70; F21V 29/74; F21V 29/503; F21V 29/60; F21V 29/50; F21V 29/10; F21V 29/00; F21K 9/232; F21Y 2107/40; F21Y 2115/10; F21W 2131/103

USPC ..... 362/294

See application file for complete search history.

(56) References Cited

U.S. PATENT DOCUMENTS 8,123,378 B1 * 2/2012 Ruberg ..... F21S 8/088 362/249.02

2009/0116233 A1 5/2009 Zheng et al.

(Continued)

FOREIGN PATENT DOCUMENTS

DE 102010001047 A1 7/2011

*Primary Examiner* — Bao Q Truong
*Assistant Examiner* — Jessica M Apenteng
(74) *Attorney, Agent, or Firm* — Hayes Soloway PC

(57) ABSTRACT

A light fixture comprises two cooling elements and a plurality of semiconductor lighting elements, wherein each cooling element has a central portion and a wall portion which extends away from the central portion and at least partially surrounds an interior of a cooling element. The two cooling elements are arranged opposite one another. An annular opening for exchange of air with the environment is present between the two cooling elements. The semiconductor lighting elements are arranged on the outside of the wall portion of the cooling elements. A corresponding cooling element has two or more vanes, wherein all vanes are connected to one another by means of a central connecting element. Each vane extends in an axial direction and in a circumferential direction and has a curvature in the axial direction and preferably a curvature in the circumferential direction.

14 Claims, 2 Drawing Sheets

(51) Int. Cl.
*F21Y 115/10* (2016.01)
*F21W 131/103* (2006.01)

(56) References Cited

U.S. PATENT DOCUMENTS

2009/0303717 A1* 12/2009 Long ..... F21K 9/00
362/249.02
2012/0170262 A1* 7/2012 Hoetzl ..... F21V 29/004
362/227
2013/0294068 A1 11/2013 Kuenzler et al.
2015/0146447 A1* 5/2015 Kuepper ..... F21V 23/06
362/516

* cited by examiner

LED RETROFIT LAMP AND COOLING ELEMENT FOR A LED RETROFIT LAMP

TECHNICAL FIELD

The present invention relates to a LED retrofit lamp and a cooling element for a LED retrofit lamp, in particular retrofit lamps as replacements for mercury vapour high-pressure lamps and sodium vapour high-pressure lamps in the field of exterior lighting and street lighting.

PRIOR ART

Mercury vapour high-pressure lamps (HQL) and sodium vapour high-pressure lamps (NAV) are conventionally used for exterior lighting and street lighting. Since in the field of lighting the trend is increasingly towards energy-saving LED lamps with a long service life, and the sale of mercury vapour high-pressure lamps within the territory of the European Union has been prohibited since 2015, there is a demand for retrofit LED lamps for exterior lighting and street lighting.

Retrofit LED lamps that are currently obtainable on the market usually significantly exceed the dimensions of HQL lamps of the same lumen category (by up to 50%). Since, in the field of exterior lighting, light fixtures with a relatively high luminous flux (for example HQL: 1800 lm-57000 lm) are used and the thermal power loss also increases with the luminous flux, the dimensions of a retrofit LED lamp are determined substantially by the necessary size of the cooling element. However, the usability of oversized lamps is substantially restricted, since the available space in the lights has been designed for the size of the original light fixture.

Known retrofit LED lamps for exterior lighting (for example the lamps marketed by LEDVANCE GmbH under the designation PARATHOM HQL LED) usually consist of a base which is adjoined by a housing to accommodate an electronic driver. A plurality of aluminium profiles (for example extruded profiles) extend in the longitudinal direction from the driver housing, so that a substantially cylindrical shape is produced. Circuit boards (PCBs) with LEDs located thereon are arranged on the aluminium profiles. A round closure plate, on which a circuit board with LEDs can likewise be arranged, is located at the end of the aluminium profiles. Therefore, this results in a substantially cylindrical shape for the actual Light Engine (i.e. the construction consisting of LEDs, circuit boards and cooling elements).

Such lamps are large and heavy (in particular because of the aluminium cooling elements used) and often do not fit into existing luminaires for exterior lighting and street lighting. Furthermore, the radiation behaviour of such lamps differs significantly from that of the HQL or NAV lamps which are to be replaced, so that the light distribution of the luminaire can no longer meet the requirements.

SUMMARY OF THE INVENTION

Starting from the known prior art, it is an object of the present invention to provide an improved retrofit lamp as well as a cooling element suitable therefor.

This object is achieved by a light fixture and a cooling element with the features of the independent claims. Advantageous further embodiments are set out in the dependent claims.

Accordingly, a light fixture is proposed that has two cooling elements and a plurality of semiconductor lighting elements (e.g., LEDs). In this case, each cooling element has a central portion and a wall portion that extends away from the central portion. The wall portion at least partially surrounds the interior of a cooling element, for example, in the shape of a mug, a partially ellipsoidal shape, etc. In this case, "partially surrounds" means that the wall portion of the cooling element can be open towards one side, for example, on the side opposite the central portion. Furthermore, "partially surrounds" means that the wall portion of the cooling element can have further openings (for example for ventilation purposes).

The two cooling elements are arranged opposite one another, i.e. so that the wall portions thereof are directed towards one another. A first cooling element can be arranged so that its central element is located adjacent to a base of the light fixture and the wall element extends away from the base, and a second cooling element can be arranged so that its central element is located at the end of the light fixture facing away from the base and the wall element extends towards the base. The use of two cooling elements facilitates access to the interior of the light fixture during assembly of the light fixture.

The semiconductor lighting elements are arranged on the outside of the wall portions of the cooling elements. The semiconductor lighting elements are preferably arranged on circuit boards, which in turn are arranged on the outside of the wall portions. Preferably, the circuit boards are flexible circuit boards (e.g., made from polyimide (PI), polyethylene terephthalate (PET), or from thin known composite materials such as FR4), that can be adapted to the shape of the wall portions of the cooling element. Rigid circuit boards may also be used, which are bent corresponding to the shape of the wall portions, for example metal core PCB (MCPCB).

Furthermore, the two cooling elements are arranged so that there is an annular opening between them, i.e. with a spacing between the wall elements. As a result, heat generated during operation of the light fixture of the semiconductor lighting elements can be at least partially absorbed by the cooling elements and emitted by the cooling elements at least partially to the air in the interior of the cooling element, i.e. in the interior of the light fixture. From there, the heated air can be exchanged with the ambient air through the annular opening between the cooling elements so that efficient removal of heat is possible.

The light fixture defines a longitudinal axis and an axial direction which extends from a base of the light fixture in the direction of the Light Engine. Since light fixtures are usually designed to be substantially rotationally symmetrical, the axial direction can coincide with any axis of rotational symmetry. In addition, the light fixture defines a radial direction, i.e. extending radially outwards perpendicular to the axial direction, and a circumferential direction, i.e. perpendicular in each case to the radial direction and the axial direction, along the circumference.

In a preferred embodiment, the two cooling elements are designed with an identical construction. This simplifies the production, since it is only necessary to plan one cooling element construction and to implement the production thereof.

It is also provided that the light fixture has more than two cooling elements, for example, a first cooling element adjacent to the base, a second cooling element on the end of the light fixture opposite the base, and a third (central) cooling element between the first and the second cooling element. An annular opening can then be provided between the two adjacent cooling elements.

In a preferred embodiment, the cooling elements are produced from heat-conducting plastic, for example, in an injection moulding process.

In a preferred embodiment, the light fixture has an electronic driver for controlling the semiconductor lighting elements. The driver is preferably arranged in the interior of a cooling element of at least one cooling element. In other words, the driver is arranged in the interior of the light fixture. In this way, a cooling element of the light fixture (and thus also the semiconductor light fixture arranged on this cooling element) can extend close to the base of the light fixture, so that light can be emitted by the entire surface of the light fixture which is visible (after insertion of the base into a socket). This improves the emission characteristics of the light fixture according to the invention by comparison with the HQL and NAV retrofit lamps known from the prior art, in which the driver is arranged in a housing between the base and the lighting elements, so that no light can be emitted in this region of the surface of the light fixture. Moreover, a larger surface is available for the removal of heat.

The light fixture can have a housing portion which serves to accommodate the driver. Such a housing portion can also serve for fastening the cooling elements to one another or to the light fixture. The housing portion can be a tubular housing portion or an elongated housing portion with a polygonal cross-section.

In a preferred embodiment each wall portion has two or more vanes. The wall portion may in particular have 2, 3, 4, 5, 6 or more vanes. The central portion can then be configured as a central connecting element, so that all vanes of a cooling element can be connected to one another by means of the central connecting element. Otherwise the vanes can be designed without further connections to one another or they can be directly connected to one another by further connecting portions (in order for example to increase the stability of the cooling element).

In a preferred embodiment each vane of the cooling element extends in the axial direction and has a curvature in the axial direction. As a result, the shape of the light fixture can be adapted to the shape of the light fixture to be replaced.

Particularly preferably, each vane of the cooling element also extends in the circumferential direction and has a curvature in the circumferential direction.

Due to a curvature in the circumferential direction, the cooling element, with its two or more vanes, surrounds the interior space of the light fixture with a kind of generated surface. Due to the curvature in the axial direction, this generated surface is not cylindrical, but the spacing of the generated surface from the longitudinal axis can be different at different points on the longitudinal axis. The curvature in the axial direction does not have to mean that a generatrix, i.e. an intersecting line of the generated surface with a plane containing the longitudinal axis, has in each point a curvature in the mathematical sense, i.e. a second derivative different from zero. In fact, a curvature in the axial direction can also be produced by a plurality of rectilinear portions of the generatrix which, however, have different pitches by comparison with the longitudinal axis.

Also, the curvature in the circumferential direction can be produced by rectilinear portions of a line of circumference, i.e. an intersecting line of the generated surface with a plane which is perpendicular on the longitudinal axis. Such a line of circumference can constitute a part of a polygon.

Due to the curvature of the vanes (either only in the axial direction or additionally in the circumferential direction) of the cooling element, it is possible to configure the cooling element so that its shape is similar to the shape of the HQL or NAV light fixture. As a result, a light fixture according to the invention fits better in existing lights. Moreover, the emission of the LEDs arranged on the cooling element takes place not only predominantly in the radial direction (and possibly in the axial forward direction) as in the case of the light fixtures known from the prior art, but can be adapted to the emission characteristic of the light fixture to be replaced, and thus can also take place in particular obliquely forwards (i.e. away from the base) and/or obliquely rearwards (i.e. towards the base).

In a preferred embodiment, the light fixture has at least two translucent, preferably transparent, covers, which in each case extend over at least a part of the plurality of semiconductor lighting elements. In one embodiment, for each cooling element, a plurality of translucent covers can be provided which in each case extend over a part of the cooling element. If the wall portion of a cooling element for example has a plurality of vanes, in each case a cover can extend over a respective vane and the light fixture can have as many covers as there are cooling element vanes. Between the individual covers, spacings can preferably be provided which enable the exchange of air with the environment. In a further embodiment, a cover extends over a respective cooling element and the light fixture has as many covers as cooling elements. Spacings can be provided in each case between two covers for the exchange of air.

The covers can be additionally provided with openings which further improve the exchange of air with the environment.

The shape of the cover preferably corresponds to the shape of the cooling elements, and thus, for example, has the curvature (single or double) described above for an embodiment of the vane of the cooling element. In this way, it is possible to position the semiconductor lighting elements as close as possible to the cover. Thus, a part of the heat generated by the semiconductor lighting elements in operation can also be emitted to the environment by means of the cover.

In all these embodiments, the translucent covers can be detachably or undetachably connected, for example by latching connections to the cooling element, in particular to the respective vane, or also to additional fastening elements of the light fixture.

The present invention further relates to a cooling element for a light fixture, preferably for a retrofit light fixture on the basis of semiconductor lighting elements (for example LEDs). The cooling element has two or more vanes, wherein all vanes are connected to one another by means of a central connecting element (central element) and together constitute a wall portion of the cooling element. Each vane extends in an axial direction and has a curvature in the axial direction.

Particularly preferably, each vane of the cooling element also extends in the circumferential direction and has a curvature in the circumferential direction.

In order to achieve the curvature in the axial direction and the curvature in the circumferential direction, in one embodiment, each vane can have a first portion in the shape of a truncated pyramid and a second portion in the shape of a truncated pyramid adjoining the first. In this case, "in the shape of a truncated pyramid," means that the portion is not a complete truncated pyramid, but only a cut-out from a truncated pyramid in the region of the extension of the vane in the circumferential direction. The second portion in the shape of a truncated pyramid is then connected to the central connecting element. Each portion in the shape of a truncated pyramid preferably consists of a plurality of rectangular cooling element portions, which are in each case arranged at an angle relative to one another, so that a curvature in the circumferential direction is produced. Each of these rectangular cooling element portions can be inherently planar.

Here and in what follows "arranged at an angle," or "enclosing an angle," means an angle which deviates both from 0° and also from 180°. Thus, according to the present understanding, two parallel planes do not enclose an angle, even if mathematically an angle of 180° could be assumed.

The lateral surfaces of the first portion in the shape of a truncated pyramid enclose a first angle with the axial direction and the lateral surfaces of the second portion in the shape of a truncated pyramid enclose a second angle with the axial direction. The first angle is different from the second angle, so that a curvature in the axial direction is produced.

Instead of using two portions in the shape of truncated pyramids which adjoin one another, in a further embodiment the curvature in the axial direction and the curvature in the circumferential direction can also be achieved by appropriate use of two portions in the shape of truncated cones. In contrast to the previously described embodiment, this leads to a continuous curvature in the circumferential direction.

A vane can also have more than two portions in the shape of truncated pyramids or truncated cones, the lateral surfaces of which in each case enclose different angles with the axial direction.

In a further embodiment, the curvature in the axial direction and the curvature in the circumferential direction can also be achieved in that each vane has two or more longitudinal portions, wherein each longitudinal portion has two or more part-portions, wherein each part-portion is arranged at an angle to the adjacent part-portions. Thus, a vane is then made up of a plurality (number of longitudinal portions times the number of part-portions per longitudinal portion) of rectangular portions, which are in each case connected to the adjacent portions, i.e. portions arranged directly alongside, and in each case enclose an angle therewith. Each of these rectangular portions can be inherently planar.

In a preferred embodiment two vanes in each case are arranged spaced apart from one another in the circumferential direction. Due to the spacing between each two vanes an exchange of air between the interior of the cooling element surrounded by the vanes and the environment is possible. Such a spacing is preferably provided between each two adjacent vanes, so that the number of spacings corresponds to the number of vanes.

The connection of a vane to the central connecting element can preferably take place by means of one or more connecting struts. Between the connecting struts openings can be provided which serve inter alia for exchange of air between the interior of the cooling element and the environment and thus improve the removal of heat.

In a further preferred embodiment, each vane has a plurality of cooling ribs on the inside, i.e. on the surface of the vane directed towards the longitudinal axis. In this case, the cooling ribs can be configured so that the spacing between the semiconductor lighting elements and the cooling ribs is minimal. For example, in an embodiment in which each vane has a plurality of longitudinal portions, the semiconductor lighting elements (or the circuit boards having the semiconductor lighting elements) can be arranged on the outside of the vane along the longitudinal portions and in each case a cooling rib can be arranged on the inside of the vane along the longitudinal portions (for example approximately in the centre, i.e. spaced approximately equally from the adjacent longitudinal portions). In this way, the thermal path between the semiconductor lighting elements and the cooling ribs is small, which enables good transport of the heat generated by the semiconductor lighting elements in operation. This heat can be transmitted by the cooling ribs into the interior of the cooling element and from there it can be removed through openings (for example due to the spacings described above between the vanes of the cooling element or through other openings) by exchange of air with the environment.

The cooling element described in the embodiments set out above is preferably produced from a heat-conducting plastic, particularly preferably from a plastic having a thermal conductivity in the range from approximately 10 W/mK to approximately 25 W/mK, more preferably for example approximately 15 W/mK or approximately 20 W/mK. The material marketed by ENSINGER GmbH under the designation TECACOMP PA66 TC black (V0287-09-3), for example, can be used as heat-conducting plastic. This composite material is based on polyamide 66 (PA66) to which graphite particles are added. As a result a thermal conductivity of 7.9 W/mK (through plane) or 18.7 W/mK (in plane) is achieved.

The production of the cooling element from a heat-conducting plastic can preferably take place in an injection moulding process. In this way, the relatively complex shape of the cooling element can be produced simply and in an easily reproducible manner.

The features of the cooling element which are explained above in connection with the light fixture according to the invention apply correspondingly to the cooling element according to the invention alone. Likewise, the features which are explained above in connection with the light fixture according to the invention apply correspondingly to the cooling elements of the light fixture according to the invention.

BRIEF DESCRIPTION OF THE DRAWINGS

Preferred further embodiments of the invention are explained in greater detail by the following description of the drawings. In the drawings.

DETAILED DESCRIPTION OF PREFERRED EXEMPLARY EMBODIMENTS

Figure 1:
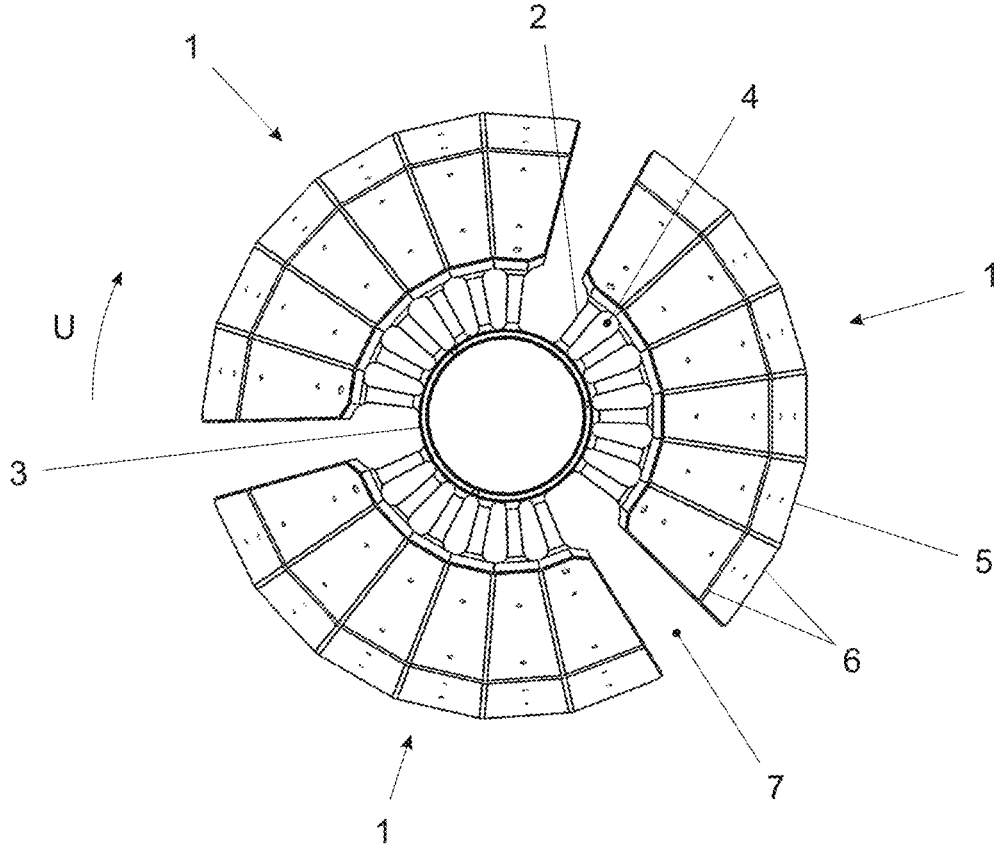
FIG. 1 shows a schematic representation of an embodiment of a cooling element according to the invention.

Preferred exemplary embodiments are described below with reference to the drawings. In this case elements which are the same, similar, or act in the same way are provided with identical reference numerals in the different drawings, and repeated description of some of these elements is omitted in order to avoid redundancies.

In FIG. 1, an embodiment of a cooling element according to the invention is illustrated schematically in plan view. The cooling element has a wall portion with three vanes 1, which are in each case connected every by means of a plurality of connecting struts 2 to an annular central connecting element 3 (central portion). Between each two adjacent connecting struts 2 of a vane 1, there is an opening 4 that serves for exchange of air between the interior of the cooling element and the environment.

Each vane 1 comprises a plurality of longitudinal portions 5. In each case, six longitudinal portions 5 per vane 1 are illustrated in the drawings, but a different number of longitudinal portions can also be used, for example 3, 4, 5, 7, 8, etc.

Each of the longitudinal portions 5 in turn comprises a plurality of part-portions 6. Six part-portions 6 per longitudinal portion 5 are illustrated in the drawings, but a different number of part-portions can also be used, for example 3, 4, 5, etc.

The cooling element is produced from a heat-conducting plastic in an injection moulding process. This means that the longitudinal portion 5 and the part-portions 6 are not separate elements which are combined to form a vane, but constitute logical portions of a vane.

In each case, two adjacent part-portions 6, which are substantially planar when viewed individually, are arranged at an angle relative to one another so that each vane has a double curvature, i.e. a curvature in circumferential direction U because of the angle between the longitudinal portions 5 or the adjacent part-portions 6 in the circumferential direction as well as a curvature in the axial direction A (perpendicular to the drawing plane in FIG. 1) because of the angle between the part-portions 6 in each case of a longitudinal portion 5.

Each vane 1 extends in the circumferential direction U over approximately 110°. As a result, a spacing 7 of approximately 10° remains between each two vanes 1. This spacing 7 allows the exchange of air between the interior of the cooling element and the environment.

Each vane 1 of the illustrated embodiment can also be described so that the vane 1 consists of two portions in the shape of truncated pyramids. In this case, each portion in the shape of a truncated pyramid constitutes a cutout of approximately 110° out of a truncated pyramid of a polyhedral pyramid. An inner portion in the shape of a truncated pyramid is fastened by means of the connecting struts 2 on the central connecting element 3. The outer surface of the inner portion in the shape of a truncated pyramid encloses an angle of approximately 25° with the axial direction.

The inner portion in the shape of a truncated pyramid adjoins an outer portion in the shape of a truncated pyramid. The outer surface of the outer portion in the shape of a truncated pyramid encloses an angle of approximately 8° with the axial direction.

Of course, the angle details given above are only provided by way of example. Other values can also be used.

Figure 2:
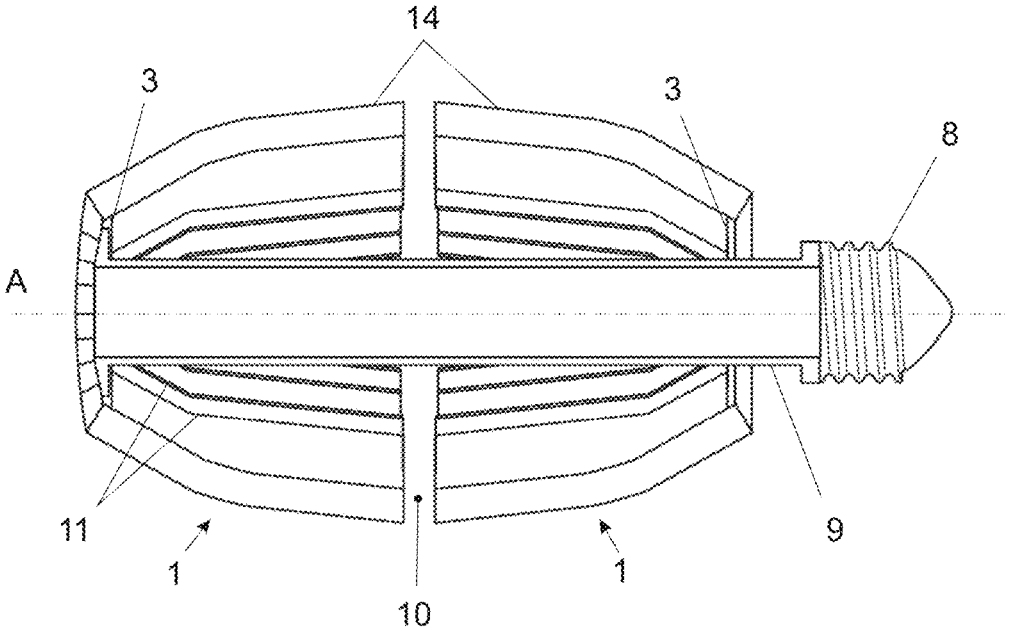
FIG. 2 shows a schematic representation of an embodiment of a light fixture according to the invention in a lateral sectional view.
Figure 3:
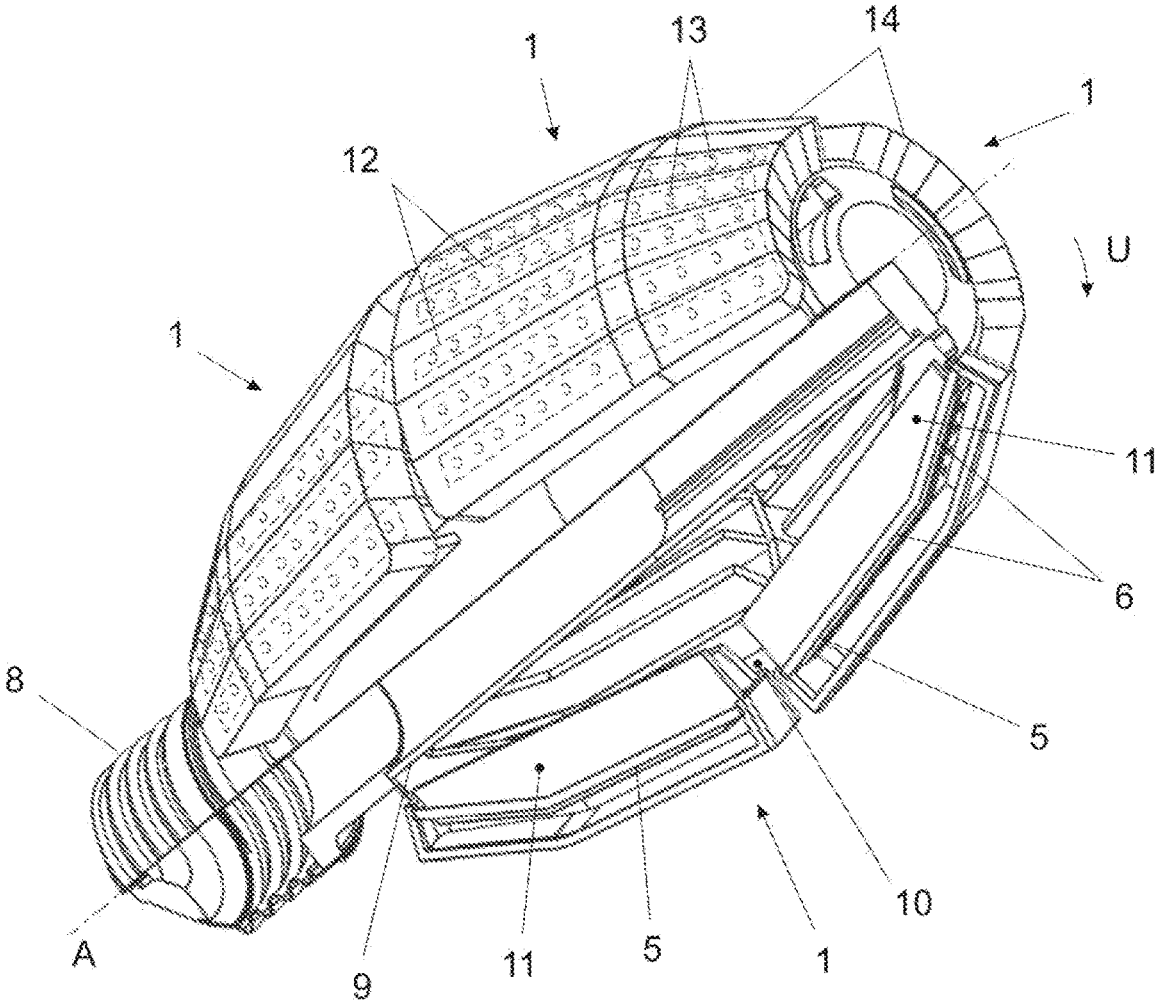
FIG. 3 shows a schematic representation of an embodiment of a light fixture according to the invention in a perspective, partially cut-away view.

An embodiment of a light fixture according to the invention is shown schematically in a lateral sectional view in FIG. 2. The same embodiment is illustrated schematically in FIG. 3 in a perspective, partially cut-away view.

The light fixture according to the invention has a base 8 (for example an Edison screw base of the E40, E27 type or the like), which is connected to a tubular driver housing 9. The driver housing 9 extends in the axial direction substantially over the entire length of the light fixture. The electronic driver (not shown) of the light fixture can accommodated in the driver housing. The driver housing is preferably manufactured from an electrically insulating material.

As illustrated in FIG. 1, two cooling elements are connected to the driver housing 9. A cooling element on the base side extends from the end of the driver housing 9 on the base side to approximately the centre thereof. A cooling element remote from the base extends from the end of the driver housing 9 remote from the base side likewise to approximately the centre thereof. A spacing 10 which remains between the ends of the cooling elements in the centre of the light fixture serves for the exchange of air between the interior of the light fixture and the environment.

Cooling ribs 11, which extend to the driver housing 9, can be seen on the inside of the vane 1. A cooling rib 11, which serves in each case as a connecting strut 2 between the longitudinal portion 5 and the central connecting element 3 or merges into the connecting strut 2, is provided for each longitudinal portion 5.

Flexible circuit boards 12, on which LEDs 13 are arranged as semiconductor lighting elements arranged on the outside of the vanes 1. A circuit board 12 is provided for each longitudinal portion 5. Cable feedthroughs (not shown) can be provided in the vanes for the electrical connection between the circuit boards 12 and the driver.

On each longitudinal portion, the LEDs 13 on the outside are arranged opposite the cooling ribs 11 on the inside. This produces the shortest possible thermal path from the LEDs 13 to the cooling ribs 11, which is advantageous for thorough heat removal.

A translucent cover 14 (in particular one with a diffuse scattering effect) is provided for each vane 1, and in each case a cover is connected to the vane 1 by means of latching elements (not shown). The translucent cover 14 provides protection of the LEDs 13 against external influences, which may be of interest particularly outdoors, in particular when the light fixture is used in a luminaire which offers no additional protection.

The distances 7, 10 between the vanes and between the cooling elements are not closed (at least not completely) by the transparent covers 14, so that furthermore an exchange of air between the interior of the light fixture and the environment is possible.

This open construction of the light fixture according to the invention ensures that the temperature of the LEDs remains within the permitted parameters regardless of the installation position (horizontal or vertical).

The light fixture described here according to the invention has a compact construction, the dimensions of which only slightly exceed (by a maximum of 10%) the dimensions of a HQL or NAV light fixture with the same illumination intensity which is to be replaced. The light fixture according to the invention can therefore be used as a retrofit lamp in many already existing lights.

By the use of a large number of LEDs (optionally with reduced output) and the uniform distribution thereof over the entire outer surface of the lamp, the light fixture according to the invention has, in the near field, a similar emission characteristic to the HQL and NAV light fixture to be replaced (i.e. the entire outer surface of the light fixture illuminates, similar to the outer surface of the bulb in the case of the light fixtures to be replaced).

Figure 4:
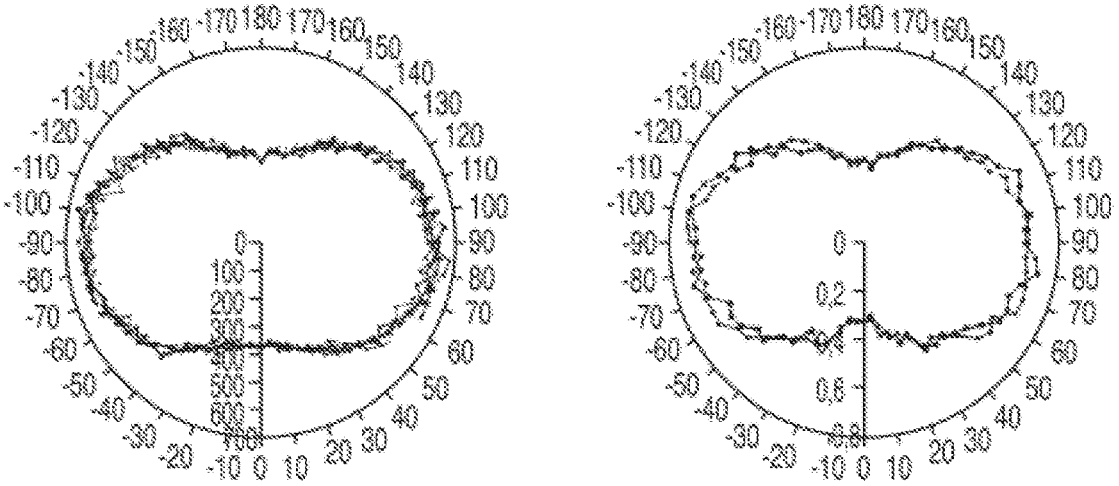
FIG. 4 shows a comparison of the light distribution of a HQL lamp with the light distribution of a light fixture according to the invention.

The homogeneity of the illuminating surface can be further improved by the use of a cover with a diffuse scattering effect over the LEDs. Moreover, the curvature of the vanes and therefore of the circuit board attached thereto makes it possible to provide sufficient light in the forward and backward direction. The emission characteristic of the light fixture according to the invention in the far field is in turn very similar to that of the HQL and NAV light fixture to be replaced. This can be seen in FIG. 4 which shows, on the left, the measured light distribution of a conventional HQL lamp and, on the right, the simulated light distribution of a light fixture according to the invention. Thus, the almost identical emission characteristic of the light fixture ensures that with the light fixture according to the invention the light distribution of a luminaire is maintained in accordance with standards.

Although the invention has been illustrated and described in greater detail by the depicted exemplary embodiments, the invention is not restricted thereto, and other variations can be deduced therefrom by the person skilled in the art without departing from the scope of protection of the invention.

In general, "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 vane
2 connecting struts
3 central connecting element
4 openings
5 longitudinal portions
6 part-portions
7 spacing between two vanes
8 base
9 driver housing
10 spacing between cooling elements
11 cooling ribs
12 circuit boards
13 LEDs
14 translucent cover
A axial direction
U circumferential direction

The invention claimed is:

1. A light fixture comprising:
two cooling elements; and
a plurality of semiconductor lighting elements;
wherein each cooling element has a central portion and a wall portion which extends away from the central portion and at least partially surrounds an interior of a cooling element, characterized in that the two cooling elements are arranged opposite one another, in that the two cooling elements are arranged so that an annular opening is present between them, and in that the semiconductor lighting elements are arranged on the outside of the wall portions of the cooling elements.

2. The light fixture according to claim 1, wherein the two cooling elements have an identical structure.

3. The light fixture according to claim 1, wherein the cooling elements are produced from heat-conducting plastic.

4. The light fixture according to claim 1, further comprising an electronic driver for controlling the semiconductor lighting elements, wherein the electronic driver is arranged in the interior of at least one of the two cooling elements.

5. The light fixture according to claim 1, further having at least two translucent covers, which in each case extend over at least a part of the plurality of semiconductor lighting elements.

6. The light fixture according to claim 1, wherein each wall portion has two or more vanes, wherein the central portion is a central connecting element, wherein all vanes of a cooling element are connected to one another by means of the central connecting element, wherein each vane extends in an axial direction, and wherein each vane has a curvature in the axial direction.

7. The light fixture according to claim 6, wherein each vane extends in a circumferential direction, and wherein each vane has a curvature in the circumferential direction.

8. A cooling element for a light fixture, the cooling element having two or more vanes, wherein all vanes are connected to one another by means of a central connecting element, and wherein each vane extends in an axial direction, characterized in that each vane has a curvature in the axial direction.

9. The cooling element according to claim 8, wherein each vane extends in a circumferential direction, and wherein each vane has a curvature in the circumferential direction.

10. The cooling element according to claim 9, wherein each vane has a first portion in the shape of a truncated pyramid and a second portion in the shape of a truncated pyramid adjoining the first portion in the shape of a truncated pyramid, wherein the second portion in the shape of a truncated pyramid is connected to the central connecting element, wherein generated surfaces of the first portion in the shape of a truncated pyramid enclose a first angle with the axial direction and generated surfaces of the second portion in the shape of a truncated pyramid enclose a second angle with the axial direction, and wherein the first angle is different from the second angle.

11. The cooling element according to claim 8, wherein each vane has two or more longitudinal portions, wherein each longitudinal portion has two or more part-portions, and wherein each part-portion is arranged at an angle to the adjacent part-portions.

12. The cooling element according to claim 8, wherein each two vanes are arranged spaced apart from one another in the circumferential direction.

13. The cooling element according to claim 8, wherein each vane is connected to the central connecting element by means of a plurality of connecting struts.

14. The cooling element according to claim 8, wherein each vane has a plurality of cooling ribs on the inside of the vane.

* * * * *